US008272481B2

(12) United States Patent
Tracey et al.

(10) Patent No.: US 8,272,481 B2
(45) Date of Patent: Sep. 25, 2012

(54) GUIDE ASSEMBLY FOR AT LEAST ONE ELEVATOR DOOR

(75) Inventors: Michael Tracey, Cromwell, CT (US); Richard Kulak, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 686 days.

(21) Appl. No.: 11/913,600

(22) PCT Filed: May 10, 2005

(86) PCT No.: PCT/US2005/016238

§ 371 (c)(1), (2), (4) Date: Sep. 8, 2009

(87) PCT Pub. No.: WO2006/121436

PCT Pub. Date: Nov. 16, 2006

(65) Prior Publication Data

US 2010/0147632 A1 Jun. 17, 2010

(51) Int. Cl.

| | |
|---|---|
| ***B66B 13/30*** | (2006.01) |
| ***E05D 15/06*** | (2006.01) |
| ***E06B 3/42*** | (2006.01) |

(52) U.S. Cl. ..... 187/333; 187/334; 49/120; 49/370; 49/411; 49/423; 52/30

(58) Field of Classification Search ..... 187/313, 187/333, 334; 49/411, 423, 370, 120; *B66B 13/30; E06B 3/42, 3/46*

See application file for complete search history.

(56) References Cited

U.S. PATENT DOCUMENTS

| | | | |
|---|---|---|---|
| 1,538,358 | A | 5/1925 | Schultz |
| 3,395,422 | A | 8/1968 | Harwood et al. |
| 4,652,146 | A | 3/1987 | Ellermann et al. |
| 4,781,270 | A | 11/1988 | Holland |
| 5,706,913 | A | 1/1998 | Rivera |
| 5,794,746 | A | 8/1998 | Ketonen et al. |
| 6,684,573 | B2 | 2/2004 | Heath et al. |

FOREIGN PATENT DOCUMENTS

| | | | | |
|---|---|---|---|---|
| EP | 1095895 | A2 | * | 5/2001 |
| GB | 2350390 | A | * | 11/2000 |
| JP | 10029784 | A | * | 2/1998 |
| JP | 10203764 | A | * | 8/1998 |
| JP | 2002020067 | A | * | 1/2002 |
| JP | 2002322858 | A | * | 11/2002 |
| JP | 2004075373 | A | * | 3/2004 |
| JP | 2004217392 | A | * | 8/2004 |

OTHER PUBLICATIONS

Search Report PCT/US05/16238.

* cited by examiner

*Primary Examiner* — Emmanuel M Marcelo
*Assistant Examiner* — Stefan Kruer
(74) *Attorney, Agent, or Firm* — Carlson, Gaskey & Olds, P.C.

(57) ABSTRACT

An elevator door guide (16) includes at least one elevator door guide member (30, 32) having a first channel (18) and a second channel (64) each for at least partially establishing a direction of door movement. The first channel (18) is open in a first direction (24) and the second channel (64) is open in a second direction (66). In one example, the channel (18) at least partially establishes a direction of door movement and a passage (26) extends through the elevator door guide (16) in a direction (28) that is transverse to the direction of door movement.

23 Claims, 4 Drawing Sheets

GUIDE ASSEMBLY FOR AT LEAST ONE ELEVATOR DOOR

1. FIELD OF THE INVENTION

This invention generally relates to elevator doors, and more particularly to a guide assembly for elevator doors.

2. BACKGROUND OF THE INVENTION

Elevator systems are widely known and used. A typical elevator system includes an elevator cab that moves within a hoistway between landings in a building, for example, to transport passengers, cargo or both between building levels. Typically, a hoistway entrance includes at least one elevator door that hangs from a set of rollers that roll along a track near the top of the hoistway entrance. The cab also has at least one door. An actuator supported on the cab moves the cab and hoistway elevator doors between open and closed positions when the cab is at a landing. The bottom of each elevator door includes a gib that is received into a guide groove within a door sill near the bottom of the door. The gib follows the guide groove as the elevator door moves. The gib and guide groove also cooperate to keep the door plumb.

Typical guide grooves require significant maintenance. The guide groove is exposed to passengers and cargo entering and exiting the elevator cab. The passengers and cargo track dirt and debris that can accumulate in the guide groove. The accumulation may increase friction between the gib and the guide groove. If the accumulation is large enough, the elevator door may not move as desired within the guide groove. Therefore, typical guide grooves continually require cleaning to remove dirt and debris from the guide groove.

One proposal has been to include a passage at the ends of the guide groove. This approach introduces the possibility for a door gib to push debris into one of the passages. A drawback to this approach is that it complicates the design of the guide assembly. Additionally, this approach is not consistent enough to avoid periodic, manual cleaning.

There is a need for an elevator guide assembly that requires less cleaning and maintenance. This invention addresses those needs and provides enhanced capabilities while avoiding the shortcomings and drawbacks of the prior art.

SUMMARY OF THE INVENTION

An example, an elevator door guide assembly includes a first channel and a second channel each for at least partially establishing a direction of door movement. The first channel opens in a first direction transverse to the direction of door movement and the second channel opens in a second, different direction. In one example, the first direction is opposite the second direction.

In one example, the elevator door guide assembly includes an elongated channel for at least partially establishing a direction of door movement and a passage extending through the elevator door guide. The passage is coextensive with the elongated channel and extends in a direction transverse to the direction of door movement.

Another example elevator door guide assembly includes a first elevator door that is movable along a first channel open in a first direction and a second elevator door that is movable along a second channel open in a second, different direction.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
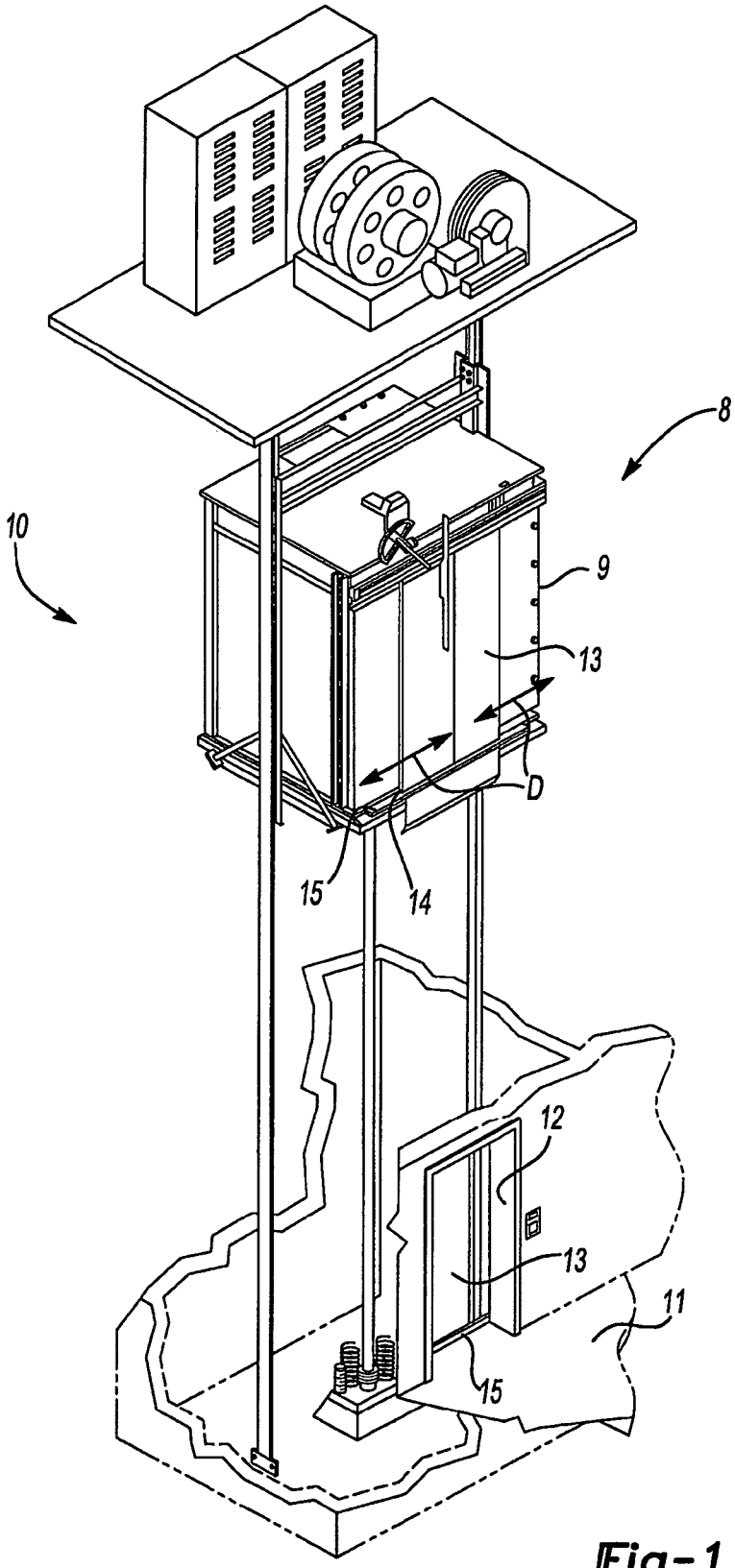
FIG. 1 diagrammatically illustrates selected portions of an example elevator system.

FIG. 1 shows selected portions of an example elevator assembly 8 including a cab 9 that moves within a hoistway 10 between building levels 11 (one shown). The cab 9 and a hoistway entrance 12 each include elevator doors 13 that move in a direction of elevator door 13 movement D between open and closed positions. A gib 14 is coupled to each elevator door 13 in a known manner and is guided within a sill assembly 15 on the cab 9 and at the hoistway entrance 12, for example. The sill assemblies 15 guide the elevator doors 13 and controls the motion of the elevator doors 13 to maintain the elevator doors 13 plumb such that the lower portion of each door 13 near the sill assembly 15 does not move significantly in directions transverse to the direction of door movement D.

Figure 2:
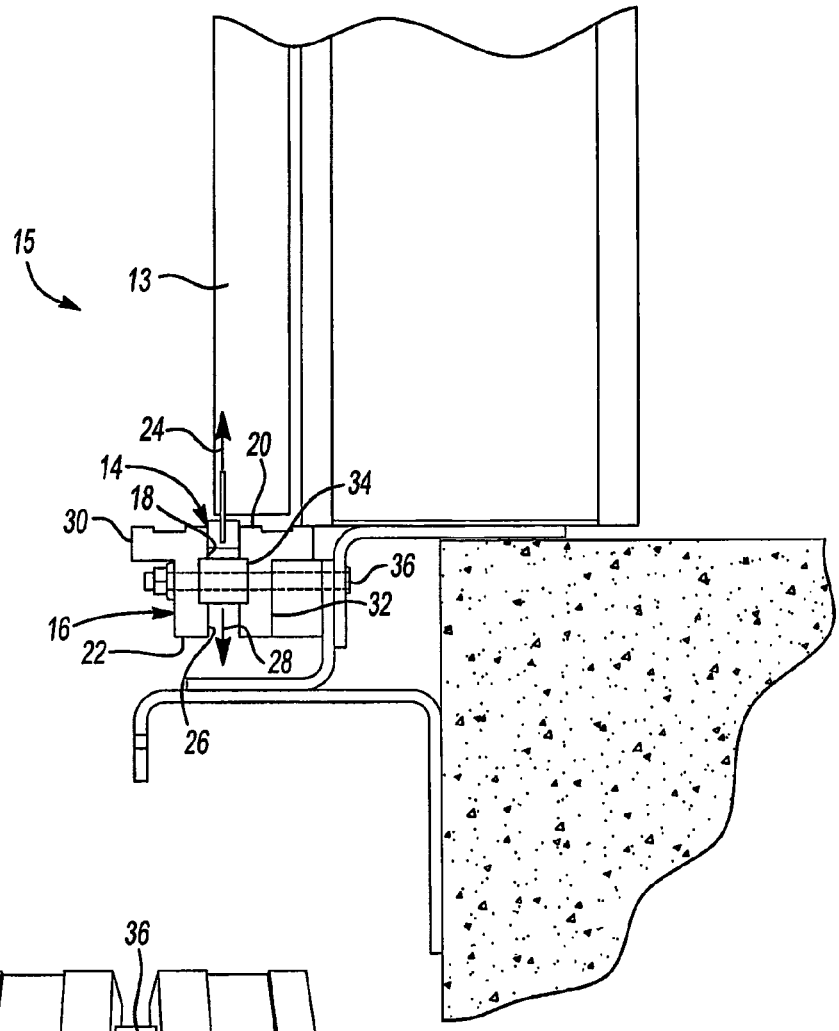
FIGS. 2 and 2A show selected portions of an example elevator door assembly.
Figure 2A:
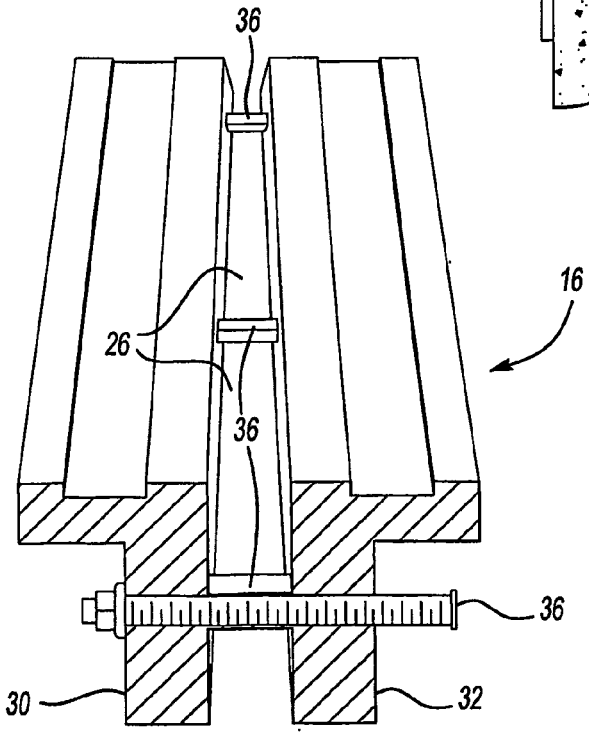

FIGS. 2 and 2A show selected portions of an example sill assembly 15 including a door guide 16 having a channel 18 that establishes the direction of elevator door 13 movement D (i.e., movement between open and closed positions). The gib 14 and channel 18 control the motion of the elevator door 13 and maintain the elevator door 13 plumb.

The door guide 16 includes a non-continuous top surface 20 and an oppositely facing, non-continuous bottom surface 22. The channel 18 is located between the first surface 20 and the second surface 22 and opens in an outward direction 24 from the door guide 16. In the illustrated example, the channel 18 opens upward in a direction 24 that is transverse to the direction of door movement D.

A passage 26 is coextensive with the channel 18 in the direction of door movement. A depth of the passage 26 extends from the channel 18 in a direction 28 towards the second surface 22. The direction 28 is transverse to the direction of door movement D. The channel 18 and passage 26 together extend between the first surface 20 and the second surface 22.

The passage 26 provides the benefit of allowing dirt or debris entering any part of the channel 18 to fall from the channel 18, through the passage 26 and out of the door guide 16 to at least reduce accumulation and build-up of dirt and debris in the door guide 16 compared to previously known door guides. In other words, the door guide 16 is essentially open from top to bottom along the entire channel 18 such that debris falls through the door guide 16 rather than accumulating in the channel 18.

In the illustrated example, the door guide 16 includes a first guide member 30 and a second guide member 32 with a space between them. A spacer member 34 is received at least partially between the first guide member 30 and the second guide member 32. In the example shown, the spacer member 34 is a cylindrically-shaped metal member, however, the spacer member 34 may be a variety of other shapes. The spacer member 34 cooperates with a securing member 36 (screw or bolt, for example) to secure the first guide member 30 and the second guide member 32 together with a space between them.

In one example, several spacer members 34 are spaced intermittently along the passage 26. The size of the spacer members 34 is not substantial enough to catch dirt or debris that falls into the channel 18. In one example, any dirt or debris that is caught by the spacer members 34 is pushed off by the gib 14 and falls through the passage 26.

Figure 3:
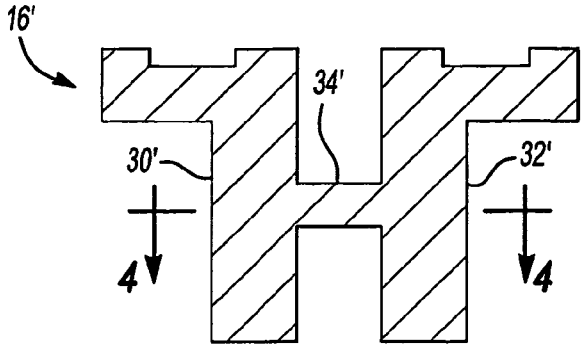
FIGS. 3 and 4 show selected portions of an example integrated elevator door guide.
Figure 4:
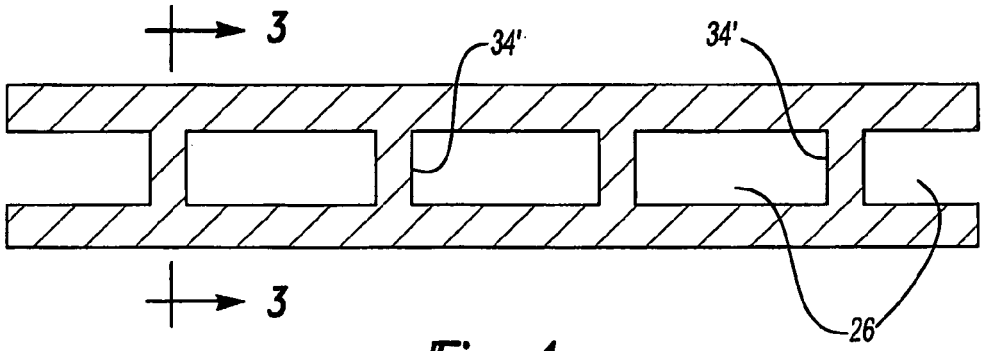

In another example shown in FIGS. 3 and 4, the door guide 16' has a first guide member portion 30', a second guide member portion 32' and spacer member portions 34' integrated into a single piece such as by casting or another known fabrication method. As illustrated in FIG. 4, the spacer member portions 34' are intermittently spaced along the passage 26.

Figure 5:
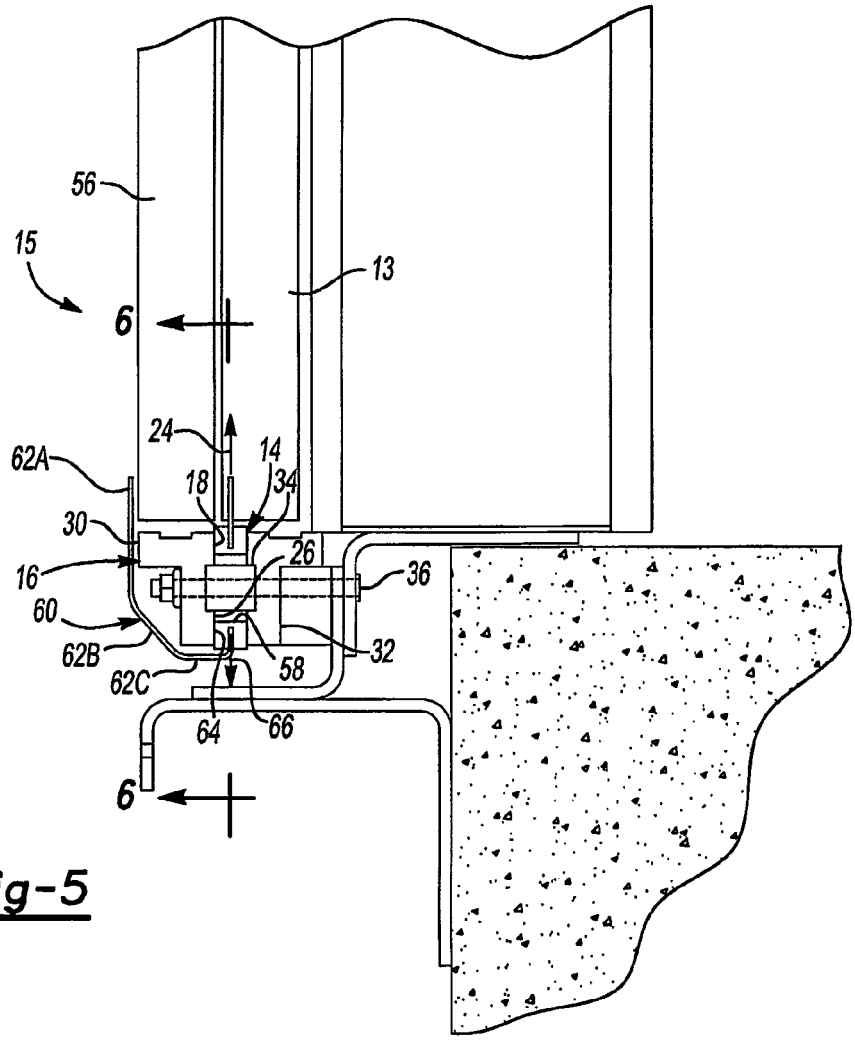
FIG. 5 shows selected portions of an example elevator door assembly in open and closed positions.

FIG. 5 shows selected portions of a second embodiment of an example door assembly where the sill assembly 15 guides a second elevator door 56. The illustrated example shows a two-speed door configuration, although, given this description, those skilled in the art will realize what door arrangement will best meet their particular needs. The second elevator door 56 includes a second gib 58 supported by a bracket member 60 that is coupled to the second elevator door 56. The bracket member 60 includes a first portion 62A coupled to the bottom of the second elevator door 56, a second portion 62B that extends transversely from the first portion 62A, and a third portion 62C that extends transversely from the second portion 62B. The third portion 62C is coupled to the second gib 58, which is at least partially received into a second channel 64 within the door guide 16.

The bracket member 60 supports the second gib 58 in the second channel 64 independent from the gib 14 and the elevator door 13. In this example, the bracket member 60 extends about the door guide 16 rather than through the channel 18 and passage 26. As can be appreciated from FIG. 5, the portion 62A of the bracket member 60 will be accommodated between the sill on the landing side and the sill on the cab when the cab and hoistway doors move together.

Having two channels 18 and 64 provides the advantage of utilizing the door guide 16 as a common design for a variety of different elevator door configurations. The embodiment shown in FIG. 2 for example, utilizes the channel 18 to guide the elevator door 13. The embodiment shown in FIG. 5 includes the same shape door guide 16 as is shown in FIG. 2, but additionally utilizes the second channel 64 to guide the second elevator door 56. Thus, the door guide 16 can be utilized to guide a single door or more than one door.

In this example, the second channel 64 opens in an outward direction 66 (downward according to FIG. 5) that is transverse to the direction of door movement. In the illustrated example, the outward direction 66 is opposite to the outward direction 24, and the channel 18 and the second channel 64 are in the same vertical plane. This provides the benefit of an essentially vertical pathway through the guide 16 (i.e., through channel 18, passage 26 and second channel 64) through which debris and dirt may fall. Therefore, the illustrated examples are not susceptible to debris collection.

Figure 6:
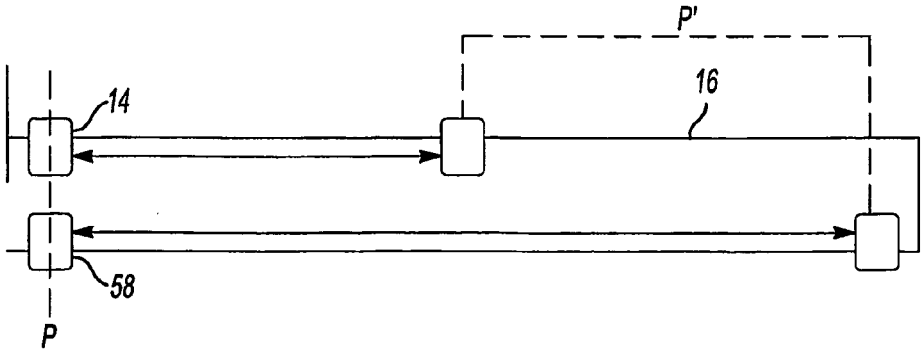
FIG. 6 shows an operational example of the positions of the gibs in open and closed positions.

FIG. 6 shows an operational example of the positions of the gib 14 and second gib 58 shown in FIG. 5 when in an open and closed position. When the elevator door 13 and the second elevator door 56 are in an open position, the gib 14 and second gib 58 are aligned vertically at a position P. When the elevator door 13 and second elevator door 56 move to a closed position P', the second elevator door 56 moves faster and farther than the elevator door 13 and the second gib 58 moves correspondingly faster and farther than the gib 14. As a result, the gib 14 and second gib 58 move out of vertical alignment when the elevator door 13 and second elevator door 56 move to the closed position P'.

Given this description, those skilled in the art will realize the versatility of the disclosed door guide and applicability to various elevator door arrangements for meeting their particular needs. Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. An elevator door guide assembly comprising:

an elevator door guide including a first elongated channel and a second elongated channel each for at least partially establishing a direction of door movement, wherein the first elongated channel is open in a first direction transverse to the direction of door movement, and the second elongated channel is open in a second, different direction transverse to the direction of door movement, the elevator door guide including a plurality of elevator door guide members and at least one spacer member located entirely between top and bottom surfaces of the plurality of elevator door guide members; and a passage extending through the elevator door guide in a direction transverse to the direction of door movement, the passage having an open top adjacent a bottom of the first elongated channel and an open bottom adjacent a top of the second elongated channel.

2. The assembly as recited in claim 1, wherein the elongated channels open in different directions, respectively, that are transverse to the direction of door movement.

3. The assembly as recited in claim 2, wherein the elongated channels are on opposite sides of the passage.

4. The assembly as recited in claim 1, wherein the elevator door guide includes first and second elevator door guide members, and the elongated channel extends at least partially between the first and second elevator door guide members.

5. The assembly as recited in claim 1, including at least one spacer member between the first and second elevator door guide members and located at least partially within the passage and a securing member cooperating with the spacer member for securing the first and second elevator door guide members together with a spacing between the first and second guide members that is coextensive with the elongated channel and the passage.

6. The assembly as recited in claim 1, including at least one securing member that is received through the at least one spacer member.

7. An elevator door assembly comprising:

a first elevator door;

a second elevator door; and an elevator door guide having a first channel facing in a first direction toward at least the first elevator door and a second channel facing in a second, different direction, wherein the elevator door guide includes first and second spaced apart guide members that establish a passage extending through the elevator door guide and between the first and second channels, the elevator door guide including a plurality of elevator door guide members and at least one spacer member located entirely between top and bottom surfaces of the plurality of elevator door guide members.

8. The assembly as recited in claim 7, including a first gib associated with the first elevator door and at least partially received in the first channel, and a second gib associated with the second elevator door and at least partially received in the second channel.

9. The assembly as recited in claim 8, including a bracket member securing the second gib to the second elevator door, the bracket member including at least one portion extending transverse to a plane of the second door between the door and another bracket portion extending parallel to the second direction and coupled to the second gib.

10. The assembly as recited in claim 9, wherein the bracket member includes a first portion extending from the second elevator door in a first bracket direction, a second portion extending from the first portion in a second bracket direction transverse to the first bracket direction, a third portion extending from the second portion in a third bracket direction transverse to the second bracket direction, and wherein the third portion is coupled to the second gib.

11. The assembly as recited in claim 7, wherein the first direction is opposite the second, different direction.

12. An elevator door assembly comprising:

a first elevator door;

a second elevator door;

an elevator door guide having a first channel facing in a first direction toward at least the first elevator door and a second channel facing in a second, different direction;

a first gib associated with the first elevator door and at least partially received in the first channel; and a second gib associated with the second elevator door and at least partially received in the second channel, wherein the first gib and the second gib move in a same direction along the first channel and the second channel, respectively, as the doors move between open and closed positions.

13. An elevator door guide assembly comprising:

a plurality of elevator door guide members including a first channel and a second channel between the plurality of elevator door guide members, each channel for at least partially establishing a direction of door movement, the first channel is open in a first direction transverse to the direction of door movement and the second channel is open in a second, different direction transverse to the direction of door movement; and at least one spacer member between the first channel and the second channel, the at least one spacer member spacing the plurality of elevator door guide members apart by a nominal distance, wherein the at least one spacer member is located entirely between top and bottom surfaces of the plurality of elevator door guide members, wherein the at least one spacer member is located entirely between top and bottom surfaces of the plurality of elevator door guide members.

14. The assembly as recited in claim 13, wherein the first direction is opposite the second direction.

15. The assembly as recited in claim 13, wherein the first direction and the second, different direction are perpendicular to the direction of door movement.

16. The assembly as recited in claim 13, wherein the first channel and the second channel are in the same vertical plane.

17. The assembly as recited in claim 13, including at least one securing member cooperating with the at least one spacer member for securing the elevator door guide members together.

18. The assembly as recited in claim 13, including an open passage coextensive with and extending between the first and second channels.

19. The assembly as recited in claim 13, including at least one securing member that is received through the spacer and that holds the plurality of elevator door guide members together.

20. The assembly as recited in claim 13, wherein the at least one spacer member is cylindrical.

21. The assembly as recited in claim 13, wherein the at least one spacer member includes a plurality of spacer members.

22. The assembly as recited in claim 13, wherein the at least one spacer member includes a plurality of spacer members that are intermittently spaced from each other.

23. The assembly as recited in claim 13, wherein the at least one spacer member is fixed to the plurality of elevator door guide members.

* * * * *